US005361381A

United States Patent [19]

Short

[11] Patent Number: 5,361,381

[45] Date of Patent: Nov. 1, 1994

[54] DYNAMIC EQUALIZING OF POWERED LOUDSPEAKER SYSTEMS

[75] Inventor: William R. Short, Ashland, Mass.

[73] Assignee: Bose Corporation, Framingham, Mass.

[21] Appl. No.: 169,713

[22] Filed: Dec. 17, 1993

Related U.S. Application Data

[63] Continuation of Ser. No. 601,461, Oct. 23, 1990, abandoned.

[51] Int. Cl.[5] ..... H04R 5/00

[52] U.S. Cl. ..... 381/24; 381/111; 381/98; 381/100; 381/102; 381/103; 381/79

[58] Field of Search ..... 381/98, 103, 79, 102, 381/101, 24, 99, 100, 111, 120

[56] References Cited

U.S. PATENT DOCUMENTS 4,592,088 5/1986 Shimada ..... 381/90
4,739,514 4/1988 Short et al. ..... 381/98
4,829,500 5/1989 Saunders ..... 381/77
4,843,624 6/1989 Rashak ..... 381/91
4,982,435 1/1991 Kato et al. ..... 381/78

FOREIGN PATENT DOCUMENTS 0158114 9/1984 Japan ..... 381/105

*Primary Examiner*—John K. Peng
*Assistant Examiner*—Nina Tong
*Attorney, Agent, or Firm*—Fish & Richardson

[57] ABSTRACT

A powered loudspeaker system has a cabinet. The cabinet has at least one electroacoustical transducer and a power amplifier coupled to the electroacoustical transducer. Dynamic equalization circuitry coupled to the power amplifier provides a predetermined desired dynamic equalization for the electroacoustical transducer in the cabinet when normally positioned in a listening room.

17 Claims, 6 Drawing Sheets

DYNAMIC EQUALIZING OF POWERED LOUDSPEAKER SYSTEMS

This is a continuation of application Ser. No. 07/601,461, filed Oct. 23, 1990, now abandoned.

BACKGROUND OF THE INVENTION

The present invention relates in general to dynamic frequency equalization and more particularly concerns novel apparatus and techniques for controlling the frequency response of a powered loudspeaker system as a function of level without introducing undesired boominess in voice reproduction.

Dynamic equalization is disclosed in U.S. Pat. No. 4,490,843, incorporated by reference herein. The patent explains that the sensitivity of human hearing to bass frequencies (relative to other frequencies) is less at lower volume levels than it is at higher volume levels. To compensate for this difference, many audio amplifying systems include a loudness control that boosts the bass and treble response at lower volume levels. Conventional loudness contours are based upon Fletcher-Munson equal-loudness curves which relate the frequency response of human hearing to the level of the sound being heard.

In the above-referenced patent, it was discovered that even though the Fletcher-Munson curves predict that one should boost the frequencies between 200 and 500 Hz, very satisfactory musical performance can be obtained even if only the frequencies below 200 Hz are boosted. Also, by limiting the boost to frequencies below 200 Hz, undesirable effects such as boominess in the reproduction of voices were reduced. There was discovered and disclosed a family of frequency contours which vary with volume control setting to improve the perceived low level music reproduction without degrading voice reproduction. Essentially, as the volume control is changed to decrease the mid and high frequency level by two decibels, the system reduces the level of a narrow band of frequencies centered about the low frequency cutoff of the loudspeaker by only one decibel. The family of curves shown in FIG. 6 of the patent is typical.

Dynamic equalization, as described above, provides full, rich sound with pleasing bass at any listening level. Conventional loudness controls (such as those that provide an inverse Fletcher-Munson curve) can not provide this effect, because in addition to boosting deep bass, they also boost mid-bass, causing male voices and instruments like cellos to sound unnaturally boomy.

Automatic dynamic equalization is disclosed in U.S. Pat. No. 4,739,514, incorporated by reference herein. This patent describes apparatus that achieves some of the benefits as the invention of U.S. Pat. No. 4,490,843, but for systems in which the volume control is not a part of the system. The Automatic Dynamic Equalization circuit senses the level of audio signal applied to its input. As the input level drops by two decibels, the bass portion of the circuit output is boosted so that its level drops by only one decibel. Such a circuit might be used in, for example, after-market car stereo systems and powered loudspeaker systems, such as the commercially available BOSE ROOMMATE system, or any other system having a conventional volume control preceding the power amplification stages.

Although automatic dynamic equalization can provide some of the benefits of dynamic equalization, it can also create artifacts. With automatic dynamic equalization, the bass boost depends on the loudness of the music. Thus, the pianissimo portion has much more bass boost than the fortissimo portion. While the resulting artifact is acceptable, and even pleasant for music with limited dynamic range (such as pop music), for music with wide dynamic range (such as classical), the artifact can negatively affect the perceived quality of reproduction.

The commercially available Bose Lifestyle music system, incorporated herein by reference, describes a program signal processing system which allows several program signal monitoring locations to independently access a centralized group of program signal sources. With this system, each monitoring location has independent access to all of the available program sources. In an audio application of this invention, the speakers which connect to the system may be wired directly to a central amplifier, but are preferably wireless and contain their own amplifiers.

When using dynamic equalization according to the invention, the frequency of boost is normally set to the low frequency cutoff of the system (which usually corresponds to the low frequency cutoff of the loudspeaker). In addition, the amount of boost is adjusted according to the absolute dB (SPL) being reproduced (which depends on the setting of the volume control, the sensitivity of the loudspeaker, and the acoustics of the listening environment). During installation, the gain and offset parameters of the dynamic equalization circuit are adjusted to account for the loudspeaker sensitivity and the acoustics of the listening environment. Thereafter, in operation, the circuit adjusts the boost level depending on the adjusted parameters, and the current level of the volume control setting. Because the boost level does not depend on position of a manual switch or the actual instantaneous loudness of the music, the amount of bass boost is always correct for the loudness level selected by the listener. For example, the fortissimo and the pianissimo portions of a symphony are reproduced with the same (correct) amount of bass boost.

According to the invention, there is a powered loudspeaker system having a cabinet. The cabinet has at least one electroacoustical transducer and a power amplifier coupled to the electroacoustical transducer. Dynamic equalization circuitry is coupled to the power amplifier and has circuit parameters for establishing a predetermined desired dynamic equalization for the electroacoustical transducer in the cabinet when normally positioned in a listening room.

Other features and advantages of the invention will be appreciated from the following detailed description and from the claims when read in connection with the accompanying drawings in which:

In the invention, dynamic equalization is applied to a powered loudspeaker system. In a powered loudspeaker system, one or more loudspeaker systems (placed in different listening environments that may have different dynamic equalization parameters), might be connected (with speaker wires or through wireless transmissions) to the same base unit.

It has been discovered that different listening environments and different loudspeaker systems may need different dynamic equalization parameters for providing a desired perceived sound over a wide range of sound levels. By locating the dynamic equalization circuitry in the powered loudspeaker itself, dynamic equalization parameters may be selected that are appropriate for that loudspeaker. The volume control circuitry is typically in the base unit. The volume is typically set by an electronic attenuator. A DC voltage applied to the attenuator sets the gain for the left and right channels, and thus sets the volume. Alternatively, the gain may be set by a digitally controlled attenuator. Such an attenuator might have N bits of digital control input used for setting gain, allowing for $2^N$ different values of gain.)

Figure 1A:
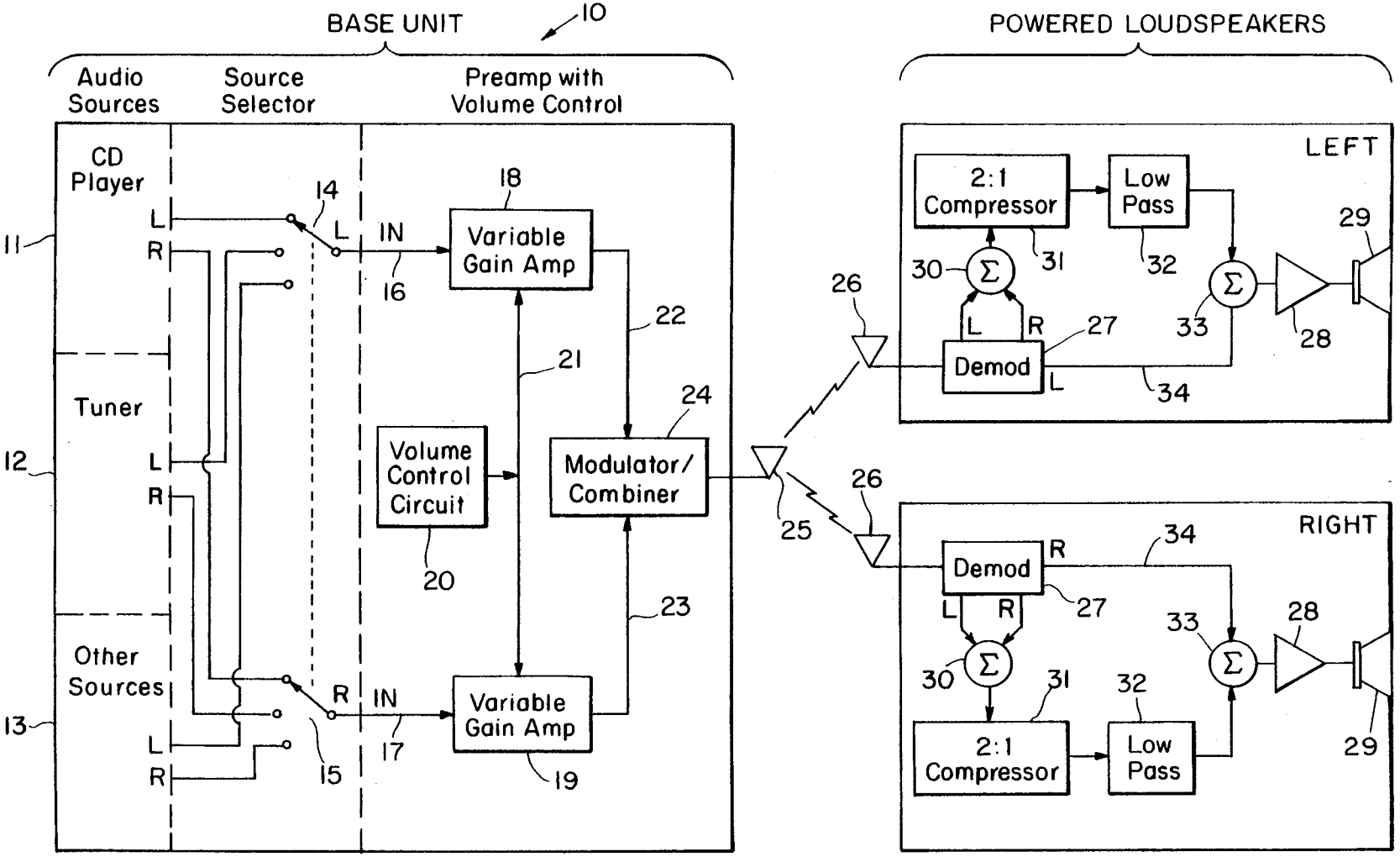
FIG. 1A illustrates a powered loudspeaker system having automatic dynamic equalization circuitry in the powered speakers.

Referring to FIG. 1A there is shown one embodiment of the invention, in which automatic dynamic equalization circuitry in the speakers provides dynamic equalization. Base unit 10 comprises a variety of audio sources, such as CD player 11, radio tuner 12, or other sources 13 (such as a tape player, phonograph player, or television audio signal). The left and right channels from the various sources are coupled through a source selector circuit (comprising selector switches 14 and 15) to form left and right audio outputs on lines 16 and 17. In the embodiment of the invention illustrated in FIG. 1A, the audio outputs on lines 16 and 17 are attenuated by two variable gain amplifiers 18 and 19. A volume control circuit 20 (which is responsive to the listener's volume setting) generates a volume control voltage which is fed on line 21 to variable gain amplifiers 18 and 19 to control the left and right channels volume.

The channel signals may be carried to the remote powered speakers through low-power speaker wires 30L and 30R, or they can be transmitted via wireless means. Where wireless transmission is used, the outputs of the variable gain amplifiers 18 and 19 are fed (via lines 22 and 23) to a modulator/combiner circuit 24. This circuit combines the left and right channel signals and transmits them to the speakers.

One means for transmission is audio signals modulated on a high-frequency carrier and transmitted from a sending antenna 25. In this case, the two audio signals may be multiplexed onto a single carrier, or may modulate two different carriers. Other well known transmission means may also be used, for example, infrared radiation transmitted and received by semiconductor diodes, ultrasonic transmissions, or any other well-known means.

The left and right channel signals are received by receiving antennas 26 (or other receiving means) at the left and right powered speakers. The received signals are then demodulated by demodulators 27. After demodulation, the two demodulated signals are fed to automatic dynamic equalization circuitry, the output of which is power amplified and transduced by amplifiers 28 and loudspeakers 29.

A detailed description of suitable automatic dynamic equalization circuitry can be found in U.S. Pat. No. 4,739,514. Generally, this circuitry may be regarded as providing a main forward signal path (along line 34) which carries an unmodified version of the appropriate (left or right) audio signal, combined with a side path that generates a low frequency boost signal for equalization. In each speaker, summing amplifier 33 adds the output of the side path to the signal from the main path, and presents the sum signal to amplifier 28 for transduction to sound.

The side path essentially comprises a summing amplifier 30, a 2:1 compressor 31, and a low-pass or band-pass filter 32. Summing amplifier 30 sums the demodulated left and right channel signals, and provides the summed result to the input of 2:1 compressor 31. The gain of 2:1 compressor 31 decreases by one decibel for every two decibels that the signal on its input decreases. As a result, the output of 2:1 compressor 31 is nonlinear, and is substantially boosted when the input signal level is low.

2:1 compressor 31 may comprise a signal path and a control path, as illustrated in FIG. 4 of U.S. Pat. No. 4,739,514. In these embodiments, the control path may include a high-pass filter, for example having a cutoff frequency at 150 Hz; such a filter would allow 2:1 compressor 31 to vary its gain only in response to mid- and high-frequency spectral components, which would cause the overall perceived loudness to more closely resemble the perceived loudness of the original sound source heard live. Also, the compression ratio need not be restricted to 2:1, but might be some other ratio to realize more exactly certain desired equalization curves. Further, the compression ratio might be made variable as a function of input level to fit even more closely desired equalization curves. The attack and decay time of 2:1 compressor 31 may be altered to minimize artifacts.

The output of 2:1 compressor 31 is fed to a low-pass or band-pass filter 32. This filter passes only the bass components of the compressed signal, in accordance with the filtering curves of FIGS. 1 and 6 of U.S. Pat. No. 4,490,843. Suitable circuitry for performing this function is disclosed in U.S. Pat. Nos. 4,490,843 and 4,739,514.

The output of filter 32 is the low frequency boost signal. As discussed above, it is added to the unfiltered left or right channel signal, respectively, and the sum is amplified and transduced.

The base unit 10 of FIG. 1A may also be used to drive a three-piece speaker system (such as the BOSE ACOUSTIMASS AM-5 system incorporated herein by reference and described in U.S. Pat. No. 4,932,060 incorporated herein by reference) having automatic dynamic equalization.

Figure 1B:
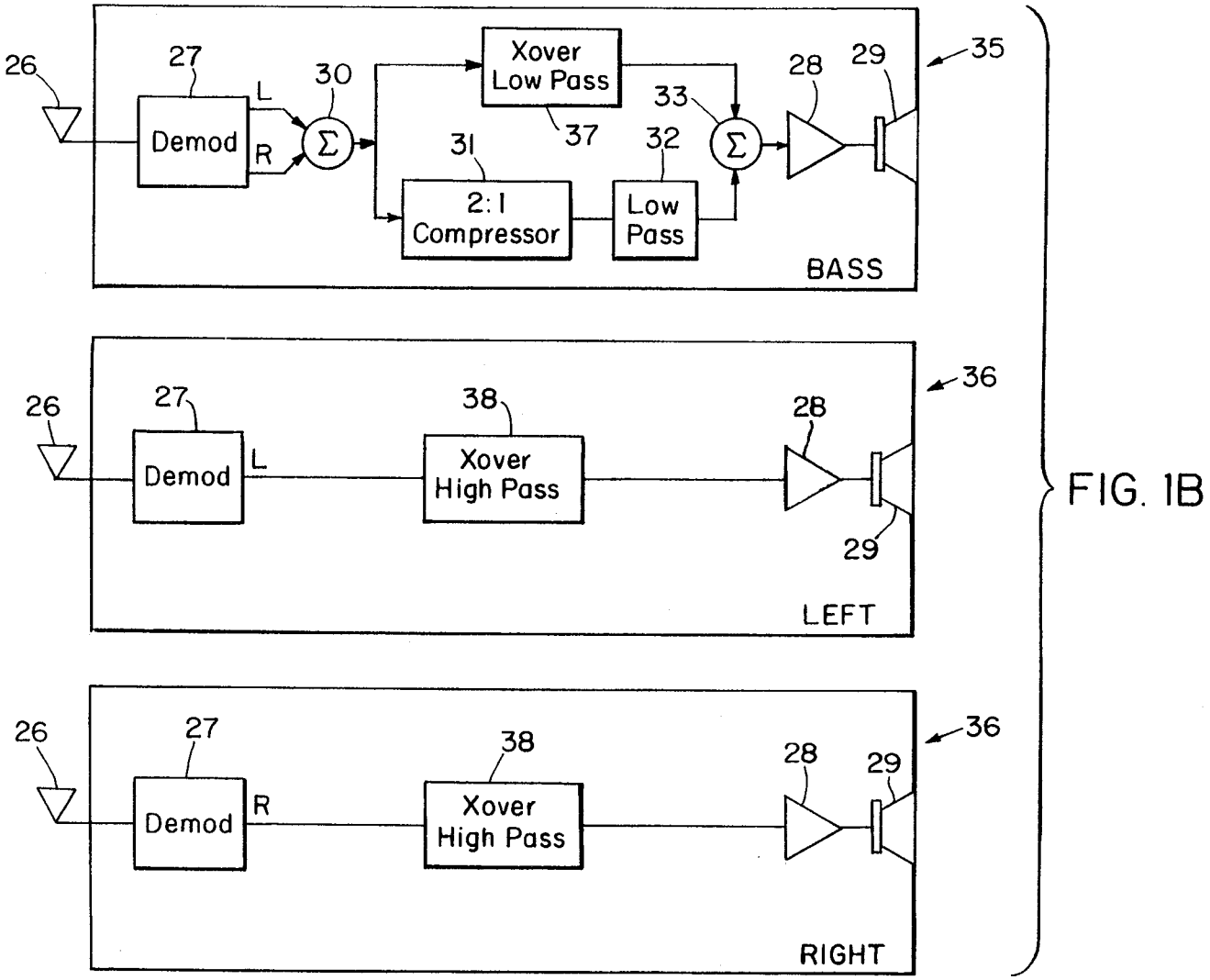
FIG. 1B illustrates a three-piece loudspeaker system for use with the base unit of FIG. 1A.

Referring to FIG. 1B, there is shown a three-piece embodiment of the invention using a single bass module 35 to transduce the low-frequency sound for the system. As the equalization affects only these low frequencies, only the bass module contains automatic dynamic equalization circuitry. The bass module receives the audio signals via a receiving antenna 26 and demodulator 27 (again, the left and right channel signals may be carried by speaker wires, or transmitted through radio-frequency, infrared, or other well-known means). The operation of demodulator 27, summing amplifier 30, summing amplifier 33, amplifier 28, and loudspeaker 29 (in this case, one or more woofers) are similar to the operation of the corresponding components in the remote speakers of FIG. 1A. The side path, including 2:1 compressor 31 and filter 32, are the same as those illustrated in FIG. 1A. However, as the bass module only reproduces low frequencies, the main path includes a crossover low-pass filter 37, which attenuates high-frequency spectral components that might cause distortion in the audio output of woofer 29.

Each of the upper frequency modules 36 also includes an antenna 26 and demodulator 27 for receiving the signals transmitted from base unit 10. The left or right demodulated signals, respectively, are filtered by crossover high-pass filters 38 before being presented to amplifiers 28 and loudspeakers 29 (in this case, the speakers are tweeters or ported tweeters such as disclosed in U.S. patent application Ser. No. 07/491,222). Crossover high-pass filters 38 attenuate low frequency spectral components that would otherwise cause distortion in the audio output of tweeters 29.

The preceding embodiments of the invention are useful where the volume control signal is not available to the remote, powered speakers. Automatic dynamic equalization may cause audible artifacts. Providing the volume control signal to the equalization circuitry at the speakers, even though it is generated in the base unit 10 and may have already been used to attenuate the audio signal therein, helps reduce these audible artifacts.

In an embodiment of the invention, the volume control signal is transmitted to the powered speakers along with the channel signals. At the speakers, a dynamic equalization circuit uses the received volume signal to set the appropriate amount of bass boost in the manner described in U.S. Pat. No. 4,490,843. Because the amount of bass boost is then determined by volume control setting, it will not vary with the level of the music, thus eliminating audible artifacts.

Figure 2A:
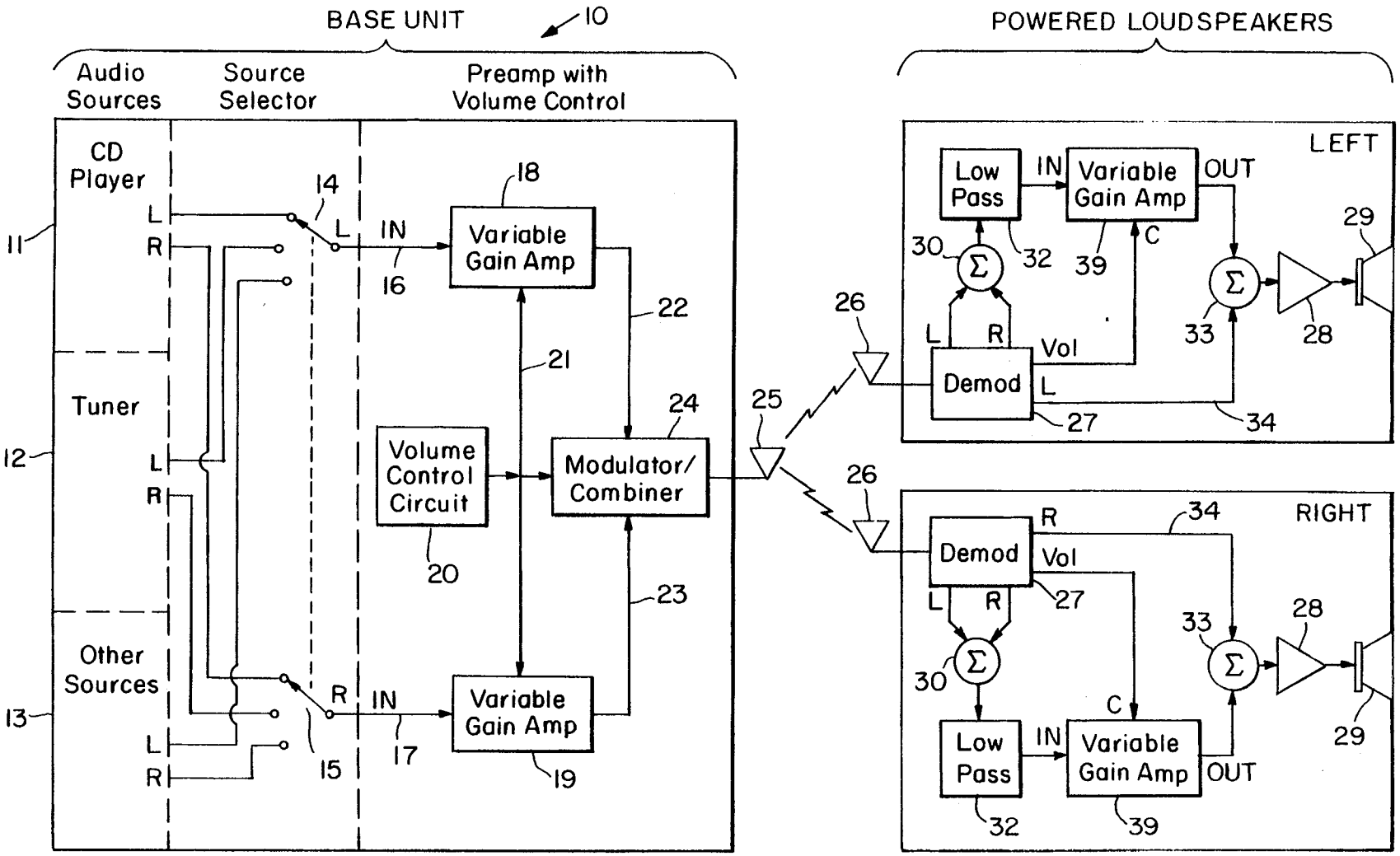
FIGS. 2A and 3A illustrate powered loudspeaker systems having dynamic equalization circuitry in the powered speakers.

A block diagram of this embodiment of the invention is illustrated in FIG. 2A. As in the embodiment of FIG. 1A, in the base unit 10 stereo signal sources 11, 12, and 13 feed selector switches 14 and 15. The preamp section includes variable gain amplifiers 18 and 19 which serve to adjust the volume. The volume control voltage is generated by the (user adjustable) volume control circuit 20. In this embodiment, the volume control voltage, as well as the left and right channel audio outputs, are fed to the powered speakers with speaker wires (not shown), or (as illustrated) by feeding the three signals to a modulator/combiner circuit 24 connected to a sending antenna 25. The volume control signal may modulate a subcarrier which is multiplexed with the audio signal carrier(s), or it may modulate an independent carrier. As with the audio channel signals, any of the well-known methods of transmitting audio and control signals may be used.

At the powered loudspeakers, the left and right audio signals and volume control signal are received and demodulated by antennas 26 and demodulators 27. Similar to the automatic dynamic equalization circuitry discussed above, the Dynamic Equalization circuitry comprises a main path and a side path. The output of the main and side paths are summed by summing amplifier 33 and presented to amplifier 28 and loudspeaker 29 for transduction to sound.

In the main path, the left or right audio signal, respectively, is carried through line 34. As this signal has already been attenuated by variable gain amplifiers 18 and 19 in the base unit 10, it is passed unmodified directly to summing amplifier 33. In the side path, the left and right audio signals are summed and fed to a low-pass or band-pass filter 32 to produce the dynamic equalization bass boost signal. The level of bass boost is determined by a variable gain amplifier 39 which is controlled by the received volume control voltage signal transmitted by base unit 10. The details of summing amplifier 30, variable gain amplifier 39 and low-pass filter 32 are described in U.S. Pat. Nos. 4,490,843 and 4,739,514. The bass boost signal output by variable gain amplifier 39 is then added (by summing amplifier 33) to the left or right channel signal, respectively, to form an equalized version of the channel signal.

Figure 2B:
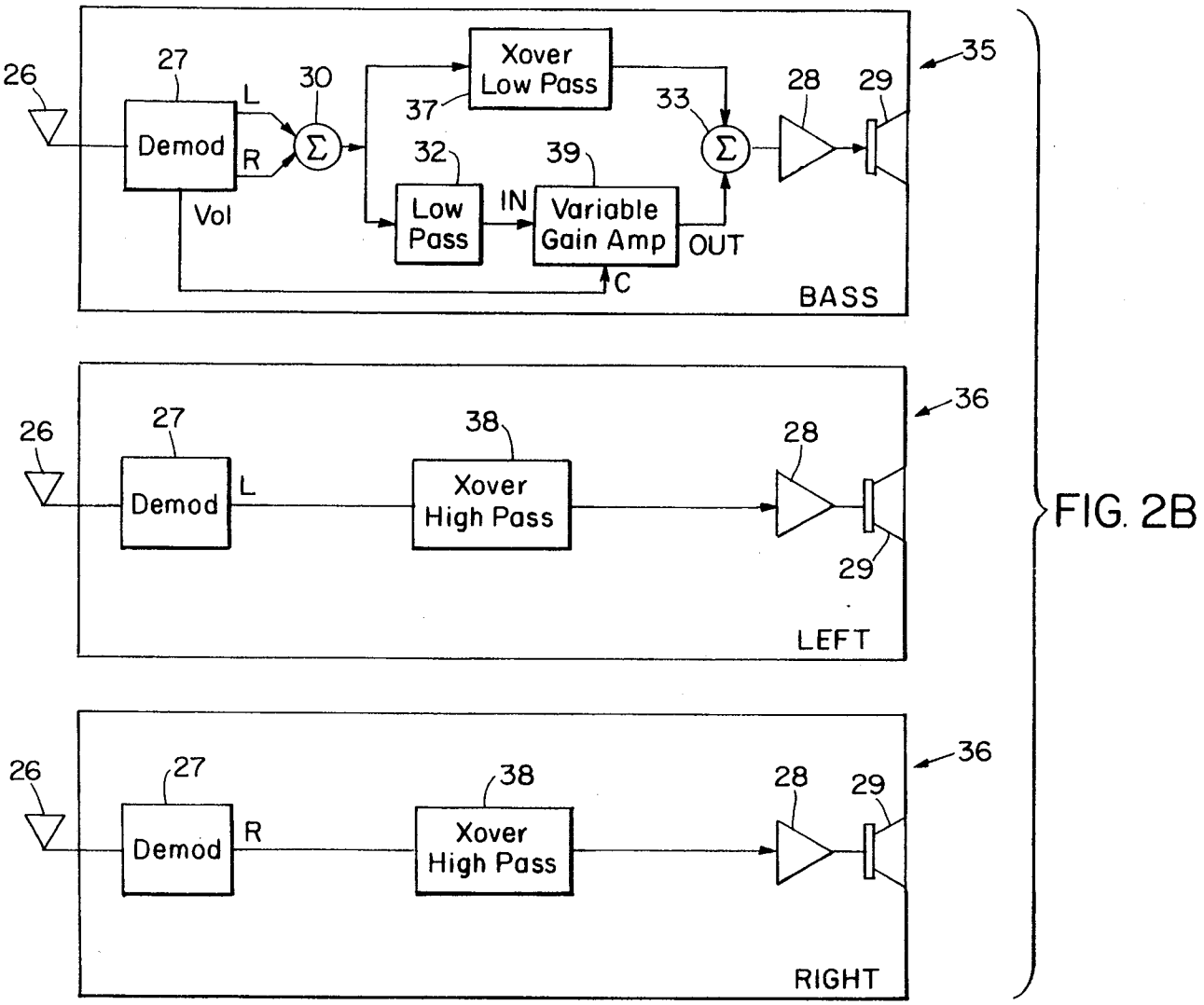
FIGS. 2B and 3B illustrate three-piece loudspeaker systems for use with the base units of FIGS. 2A and 2B, respectively.

The embodiment of FIG. 2A may also be applied to a three-piece speaker system, as illustrated in FIG. 2B. In this case, the dynamic equalization circuitry is used only in the bass module 35. The side path is the same as shown in FIG. 2A, including low-pass filter 32 and variable gain amplifier 39. However, the main path also includes a crossover low-pass filter, to reduce distortion as discussed above with reference to FIG. 1B. The upper frequency modules 36 are identical to those shown in FIG. 1B.

Figure 3A:
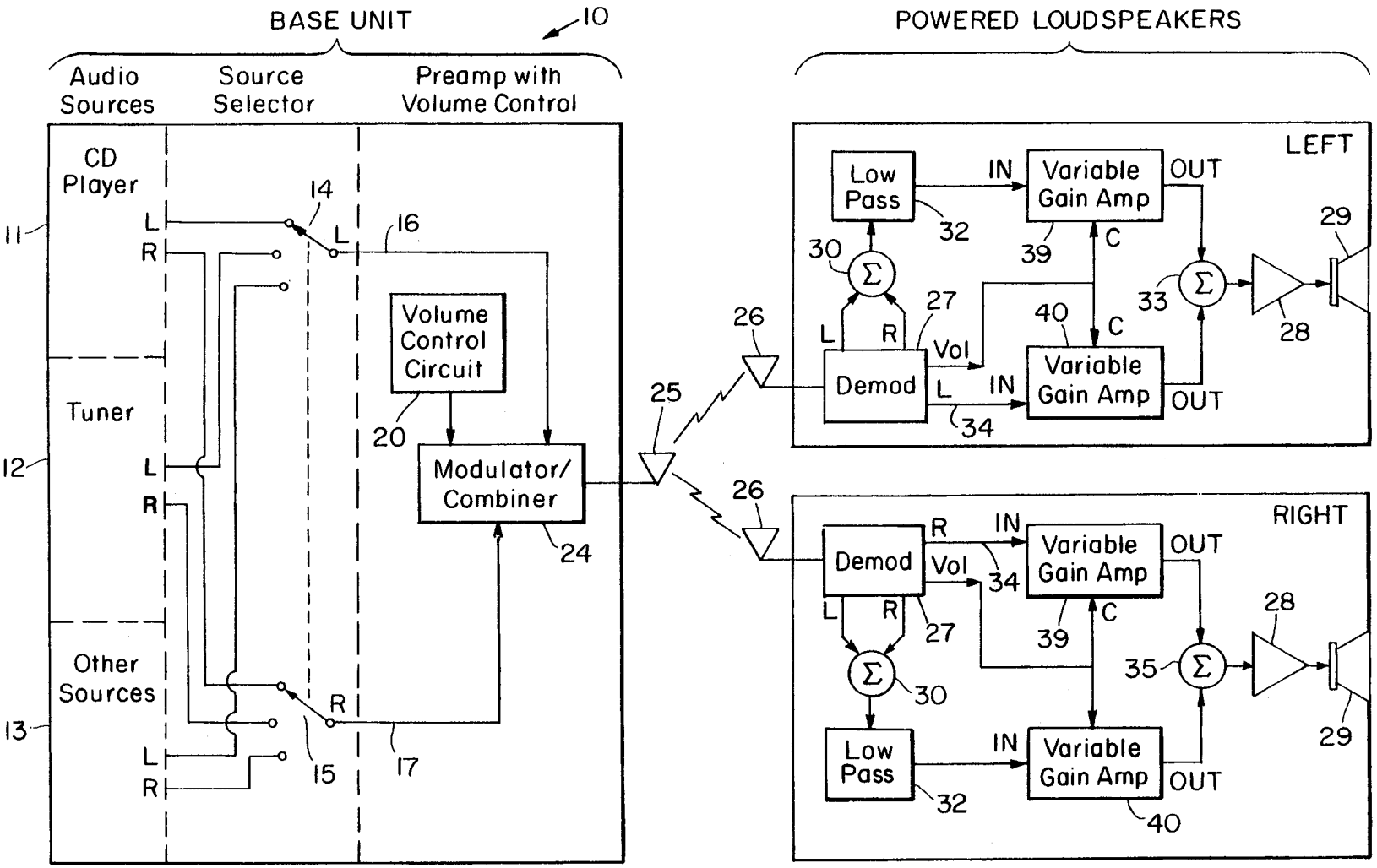

Referring to FIG. 3A, in another embodiment of the invention utilizing dynamic equalization, the attenuation of the left and right channel signals is also performed by the powered speakers. In these embodiments, the selected left and right channel signals (carried on lines 16 and 17) are not attenuated before transmission by modulator/combiner 24 and antenna 25. The left and right channels signals are received unattenuated (along with the volume control signal) by antennas 26 and demodulators 27 at the powered loudspeakers. The side path of the dynamic equalization circuit (including summing amplifier 30, low-pass or band-pass filter 32, and variable gain amplifier 39) is identical to that shown in FIG. 2A. However, the main path includes an additional variable gain amplifier 40, responsive to the received volume control signal, for attenuating the channel signal before amplification. Thus the volume control function is effectively moved to the remote speaker.

Figure 3B:
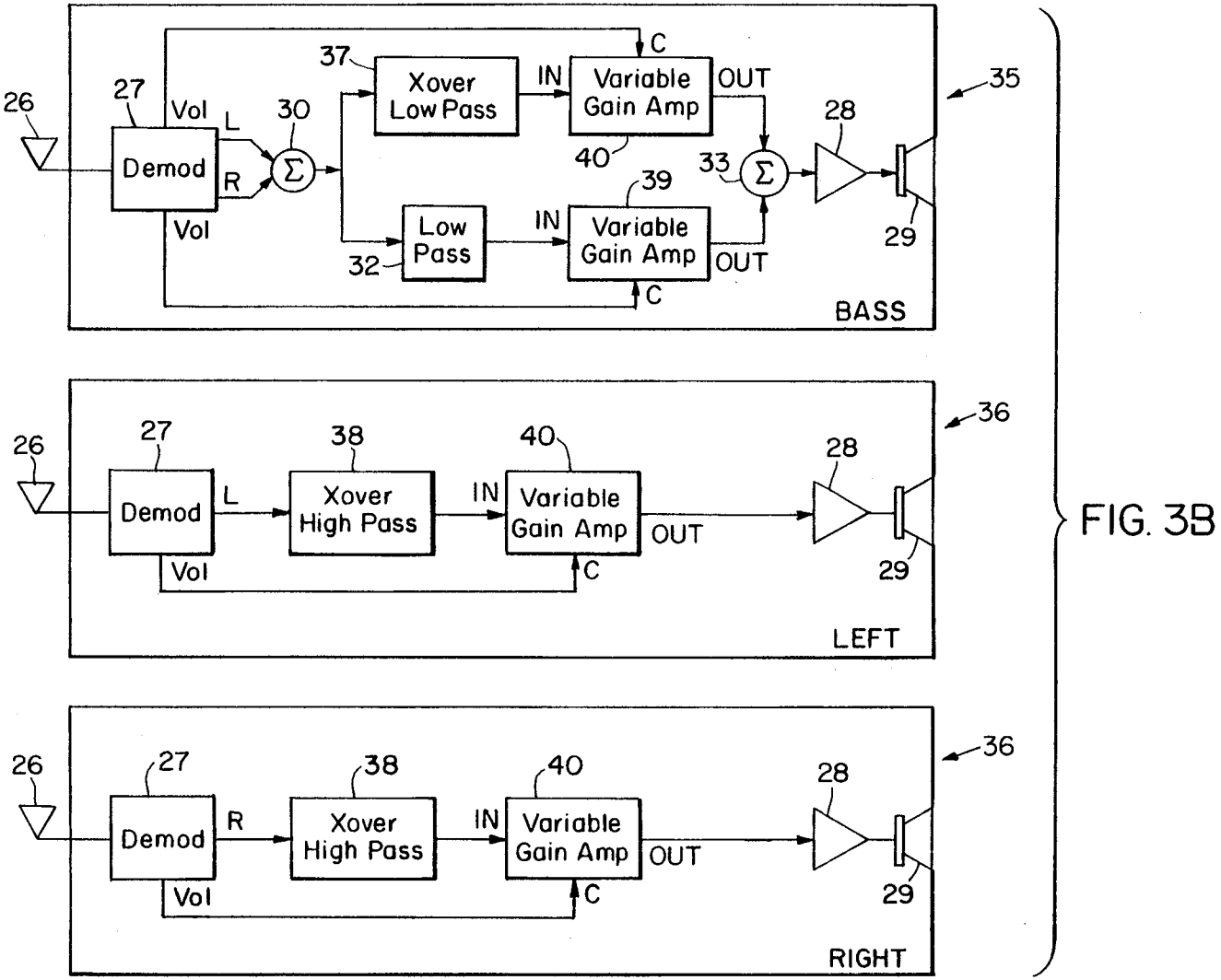

A three-piece speaker system for use with the base unit 10 of FIG. 3A is illustrated in FIG. 3B. In the bass module 35, the side path is substantially similar to that illustrated in FIG. 2B. However, the main path includes (after crossover low-pass filter 37) a variable gain amplifier 40 responsive to the received volume control signal for attenuating the main path signal. The upper frequency modules 36 are substantially similar to those illustrated in FIG. 2B. However, the demodulators 27 also demodulate and output the volume control signal, and variable gain amplifiers 40 responsive to the received volume control signal are placed between the crossover high-pass filters 38 and amplifiers 28, thereby adjusting the channel volume in response to the volume control signal.

The embodiments of FIGS. 3A and 3B have the advantage that the channel signals are transmitted unattenuated, which may improve the signal-to-noise performance of the system. The resulting improvement would be particularly noticeable, for example, where RF is used for transmission and the system is installed in a noisy RF environment such as an urban apartment building.

OTHER EMBODIMENTS

Other embodiments are within the scope of the following claims. For example, the embodiments of FIGS. 2A–3B may be made more tolerant to noise, and also made compatible with the base unit of FIG. 1A, by including automatic dynamic equalization circuitry (such as shown in FIGS. 1A–1B) in the speakers of FIGS. 2A–3B. Demodulator 27 would be modified to output an indication of the strength of the received volume control signal. As long as the strength of the received volume control signal exceeded a given threshold, the dynamic equalization circuitry would be used; otherwise (for example, if noise corrupted the volume control signal, or if the base unit of FIG. 1A was used in place of the base units of FIGS. 2A or 3A), the speakers would switch over and use the automatic dynamic equalization circuitry.

Furthermore, base unit 10 may include two or more remotely controlled channel selection switches, such as embodied in the commercially available Bose Lifestyle music system. In this embodiment, each of two or more sets of speakers (the sets corresponding to those shown in FIGS. 1A–3B of the present application) would be responsive to independent channel and, where applicable, volume control signals.

It is evident that those skilled in the art may now make numerous uses and modifications of and departures from the specific embodiments described herein without departing from the inventive concepts. Consequently, the invention is to be construed as embracing each and every novel feature and novel combination of features present in or possessed by the apparatus and techniques herein disclosed and limited solely by the spirit and scope of the appended claims.

What is claimed is:

1. A loudspeaker system comprising a base unit having a volume control circuit and comprising means for transmitting an audio channel signal of level controlled by said volume control circuit, and a powered speaker having a cabinet with said powered speaker including said cabinet being remote from said base unit with at least an electroacoustical transducer and power amplifier supported by said cabinet and further comprising, means supported by said cabinet for receiving said transmitted audio channel signal, a direct signal processing path supported by said cabinet producing a direct path output signal and a side signal processing path supported by said cabinet producing a side path output signal, said side signal processing path comprising a variable attenuator responsive to said received audio channel signal to produce a variably attenuated signal, and a low-pass filter responsive to said variably attenuated signal to produce said side path output signal, means supported by said cabinet for combining said direct and side path output signals to produce a processed audio signal, and said electroacoustical transducer responsive to said processed audio signal to generate audible sound, whereby the low frequency components of said audio channel signal are boosted such that, when said processed audio signal is generated at low audible sound levels, listeners have improved perception of the bass spectral components of said audio channel signal.

2. The loudspeaker system of claim 1, wherein said transmitting means further comprises means for transmitting multiple audio channel signals, said receiving means further comprises means for receiving multiple audio channel signals, and said side signal processing path further comprises a combiner responsive to said multiple received audio channel signals to produce a combined signal, wherein said variable attenuator is responsive to said combined signal.

3. The loudspeaker system of claim 2, wherein said filter produces a filtered signal having substantially reduced content in the frequencies above 200 Hz.

4. The loudspeaker system of claim 1, wherein said transmission means comprises a radio frequency modulator, and said receiving means comprises a radio frequency demodulator.

5. The loudspeaker system of claim 1, wherein said transmission means comprises an infrared light emitting device, and said receiving means comprises an infrared light sensitive device.

6. The loudspeaker system of claim 1, wherein said transmission means comprises an ultrasonic radiator, and said receiving means comprises an ultrasonic detector.

7. The loudspeaker system of claim 1, wherein said means for transmitting and said means for receiving comprises low-power speaker wires.

8. The loudspeaker system of claim 1, wherein said base unit further comprises a volume control signal generator responsive to user input to produce a volume control signal, and a channel signal attenuator responsive to said volume control signal to vary the gain of said audio channel signal prior to transmission.

9. The loudspeaker system of claim 8 wherein said variable attenuator comprises a compressor having a gain inversely proportional to the level of said received audio channel signal.

10. The loudspeaker system of claim 9 wherein said direct signal processing path comprises a low-pass crossover filter responsive to said received audio channel signal to produce said direct path output signal, and further comprising a second powered speaker comprising second means for receiving said transmitted audio channel signal, a high-pass crossover filter responsive to the audio channel signal received by said second receiving means to produce an upper frequency signal, and an upper frequency transducer responsive to said upper frequency signal to generate audible sound.

11. The loudspeaker system of claim 1 wherein said base unit further comprises a volume control signal generator responsive to user input to produce a volume control signal, and said transmitting means further comprises means for transmitting said volume control signal, and said receiving means further comprises means for receiving said volume control signal.

12. The loudspeaker system of claim 11 wherein said variable attenuator is responsive to said received volume control signal to control the gain of said variably attenuated signal.

13. The loudspeaker system of claim 12 wherein said base unit further comprises a channel signal attenuator responsive to said volume control signal to vary the gain of said audio channel signal prior to transmission.

14. The loudspeaker system of claim 13 wherein said direct signal processing path comprises a low-pass crossover filter responsive to said received audio channel signal to produce said direct path output signal, and further comprising a second powered speaker comprising second means for receiving said transmitted audio channel signal, a high-pass crossover filter responsive to the audio channel signal received by said second receiving means to produce an upper frequency signal, and an upper frequency transducer responsive to said upper frequency signal to generate audible sound.

15. The loudspeaker system of claim 12 wherein said direct path comprises a channel signal attenuator responsive to said received volume control signal to control the gain of said direct path output signal.

16. The loudspeaker system of claim 1 wherein said direct signal processing path further comprises a low-pass crossover filter to reduce the upper frequency content of said direct path output signal, and further comprising a second powered speaker comprising second means for receiving said transmitted audio channel signal and said volume control signal, a high-pass crossover filter responsive to the audio channel signal received by said second receiving means to produce an upper frequency signal, a second channel signal attenuator responsive to the volume control signal received by said second receiving means to control the gain of said upper frequency signal, and an upper frequency transducer responsive to the output of said second channel signal attenuator to generate audible sound.

17. A powered loudspeaker system comprising, a cabinet, said cabinet having at least one electroacoustical transducer and a power amplifier coupled to said electroacoustical transducer, and dynamic equalization circuitry having an audio channel input for receiving an audio channel signal supported by said cabinet and coupled to said power amplifier having circuit parameters for establishing a predetermined desired dynamic equalization for said electroacoustical transducer and circuitry constructed and arranged to receive control signals from a location remote from the location of said cabinet in said cabinet when normally positioned in a listening room, said electroacoustical transducer responsive to a processed audio signal coupled from said audio channel input through said dynamic equalization circuitry and said power amplifier to generate audible sound, whereby low frequency Components of an audio signal applied to said audio channel input are boosted such that, when said processed audio signal is generated at low audible sound levels, listeners have improved perception of the bass spectral components of the audio channel signal applied to said audio channel input.

* * * * *